US010819044B2

(12) United States Patent
Sato

(10) Patent No.: US 10,819,044 B2
(45) Date of Patent: Oct. 27, 2020

(54) TERMINAL-EQUIPPED ELECTRICAL WIRE

(71) Applicant: YAZAKI CORPORATION, Tokyo (JP)

(72) Inventor: Kei Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/434,885

(22) Filed: Jun. 7, 2019

(65) Prior Publication Data

US 2020/0014127 A1 Jan. 9, 2020

(30) Foreign Application Priority Data

Jul. 9, 2018 (JP) ..... 2018-130100

(51) Int. Cl.
*H01R 4/18* (2006.01)
*H01R 4/62* (2006.01)

(52) U.S. Cl.
CPC ..... *H01R 4/185* (2013.01); *H01R 4/62* (2013.01)

(58) Field of Classification Search
CPC ..... H01R 4/184; H01R 4/185; H01R 4/186; H01R 4/188; H01R 4/62
See application file for complete search history.

(56) References Cited

U.S. PATENT DOCUMENTS 9,711,872 B2 * 7/2017 Sato ..... H01R 13/52
9,847,596 B2 * 12/2017 Sato ..... H01R 4/185
10,096,913 B2 * 10/2018 Sato ..... H01R 4/185
10,236,652 B2 * 3/2019 Saito ..... H01R 43/058
10,381,794 B2 * 8/2019 Saito ..... H01R 43/048
10,505,287 B2 * 12/2019 Sato ..... H01R 4/185
2015/0140856 A1 * 5/2015 Sato ..... H01R 4/183 439/523
2015/0180138 A1 6/2015 Ohnuma
2017/0005417 A1 * 1/2017 Aoki ..... H01R 13/52
2017/0179619 A1 6/2017 Nakata et al.
2018/0069327 A1 * 3/2018 Nakata ..... H01R 4/70
2019/0027883 A1 1/2019 Saito
2019/0036237 A1 * 1/2019 Maehori ..... H01R 4/62
(Continued)

FOREIGN PATENT DOCUMENTS

CN 104508911 A 4/2015
CN 107046184 A 8/2017
(Continued)

*Primary Examiner* — Ross N Gushi
(74) *Attorney, Agent, or Firm* — Kenealy Vaidya LLP

(57) ABSTRACT

A terminal-equipped electrical wire includes an electrical wire and a terminal fitting that is attached to the electrical wire. In the electrical wire, the terminal fitting includes a barrel portion crimped to a conductor core wire exposed from the electrical wire, and a contact portion to be connected to a mating terminal. The barrel portion is a cylindrical plate-like body in which one end and the other end overlap with each other after crimping, and has a plate-like body including a proximal end portion covering a sheath of the electrical wire, a distal end portion covering the conductor core wire away from the proximal end portion, and an intermediate portion connecting the proximal end portion and the distal end portion and covering the conductor core wire so as to isolate it from the outside between the proximal end portion and the distal end portion.

7 Claims, 8 Drawing Sheets

(56) References Cited

U.S. PATENT DOCUMENTS

| | | | | |
|---|---|---|---|---|
| 2019/0036238 | A1* | 1/2019 | Maehori | H01R 4/185 |
| 2019/0140366 | A1 | 5/2019 | Nomura et al. | |
| 2019/0280399 | A1* | 9/2019 | Sato | H01R 4/188 |
| 2019/0280401 | A1* | 9/2019 | Sato | H01R 4/185 |
| 2019/0280422 | A1* | 9/2019 | Sato | H01R 4/184 |
| 2019/0280444 | A1* | 9/2019 | Sato | H01R 43/048 |
| 2020/0014127 | A1* | 1/2020 | Sato | H01R 4/70 |
| 2020/0014130 | A1* | 1/2020 | Sato | H01R 43/16 |

FOREIGN PATENT DOCUMENTS

| | | | |
|---|---|---|---|
| CN | 109286084 | A | 1/2019 |
| JP | 2010-45007 | A | 2/2010 |
| JP | 2010-232119 | A | 10/2010 |
| JP | 2013-62204 | A | 4/2013 |
| JP | 5940198 | B2 | 6/2016 |
| JP | 2017-111945 | A | 6/2017 |
| WO | 2017/195751 | A1 | 11/2017 |

* cited by examiner

TERMINAL-EQUIPPED ELECTRICAL WIRE

CROSS-REFERENCE TO RELATED APPLICATIONS

This application is based on Japanese Patent Applications No. 2018-130100 filed on Jul. 9, 2018, the entire contents of which are incorporated herein by reference.

BACKGROUND

1. Technical Field

The present invention relates to a terminal-equipped electrical wire in which a terminal fitting is attached to an electrical wire.

2. Related Art

In recent years, for the purpose of light weightness, and so on, a wire harness for wiring in a vehicle for example uses a terminal-equipped electrical wire that includes an electrical wire (hereafter referred to as "aluminum electrical wire") having a conductor core wire made of aluminum or aluminum alloy, and a terminal fitting made of copper or copper alloy and attached to the electrical wire.

This terminal-equipped electrical wire is likely to have water caught between the core wire of the electrical wire and the terminal fitting, which are the dissimilar metals, in which case the water acts as an electrolytic solution, resulting in galvanic corrosion (contact corrosion of dissimilar metals). As is well known, the galvanic corrosion occurs due to the difference in standard electrode potential between the dissimilar metals.

Therefore, in one of the conventional terminal-equipped electrical wires made by using aluminum electrical wires, a seal member for waterproofing is provided in the barrel portion of the terminal fitting to isolate the entire conductor core wire crimped to the barrel portion from the outside.

As a result, the galvanic corrosion of the conductor core wire is suppressed, and the reliability of electrical connection between the terminal fitting and the conductor core wire can be maintained for a long time (for example, see Japanese Patent No. 5940198).

However, in the conventional terminal-equipped electrical wire described above, it is considered that, when actually mass-producing the terminal-equipped electrical wires, the sealing material is required to be attached to the barrel portion of each terminal fitting while being aligned in position so as not to cause positional displacement or the like, and it is difficult to improve the productivity of the terminal-equipped electrical wires. Thus, while the conventional terminal-equipped electrical wire can maintain the reliability of electrical connection, it is considered that there is room for further improvement in actual production.

The invention has been made in view of the circumstances described above, and it is desirable to provide a terminal-equipped electrical wire capable of achieving both high productivity and sustained reliability of the electrical connection.

SUMMARY OF INVENTION (1) According to an aspect of the invention, a terminal-equipped electrical wire includes an electrical wire and a terminal fitting that is attached to the electrical wire. In the electrical wire, the terminal fitting includes a barrel portion crimped to a conductor core wire exposed from the electrical wire, and a contact portion to be connected to a mating terminal. The barrel portion is a cylindrical plate-like body in which one end and the other end overlap with each other after crimping, and has a plate-like body including a proximal end portion covering a sheath of the electrical wire, a distal end portion covering the conductor core wire away from the proximal end portion, and an intermediate portion connecting the proximal end portion and the distal end portion and covering the conductor core wire so as to isolate it from the outside between the proximal end portion and the distal end portion. When a core wire compression rate is defined as ((S1−S2)/S1) which is a ratio of a value obtained by subtracting a cross-sectional area S2 of the conductor core wire after crimping from the cross-sectional area S1 of the conductor core wire before crimping with respect to the cross-sectional area S1 of the conductor core wire before crimping. The barrel portion is crimped to the conductor core wire such that the core wire compression rate of a high compression region, which is located closer to the proximal end side than the opening at the distal end side in the distal end portion, is greater than the core wire compression rate of the region other than the high compression region in the distal end portion, and the barrel portion includes regions depressed in a direction to reduce the cross-sectional area of the conductor core wire as the high compression region provided at a portion where the one end and the other end overlap with each other in the distal end portion.

(2) According to another aspect of the invention, in the terminal-equipped electrical wire according to the aspect (1), wherein an end of the conductor core wire is exposed from the barrel portion and extends away from the barrel portion.

(3) According to another aspect of the invention, in the terminal-equipped electrical wire according to the aspect (2), an amount of exposure of the conductor core wire from the barrel portion is an amount of exposure of the end of the conductor core wire in the high compression region R when the conductor core wire is corroded in a predetermined corrosion test.

(4) According to another aspect of the invention, in the terminal-equipped electrical wire according to any one of the aspects (1) to (3), the barrel portion includes portions penetrating the distal end portion in a thickness direction of the distal end portion so that the conductor core wire is visually recognizable.

(5) According to another aspect of the invention, in the terminal-equipped electrical wire according to any one of the aspects (1) to (4), the barrel portion includes portions penetrating the proximal end portion in the thickness direction of the proximal end portion so that the sheath is visually recognizable.

According to the terminal-equipped electrical wire according to the configuration of (1) described above, the plate-like body which constitutes the barrel portion is crimped to the conductor core wire to form a cylindrical shape in which one and the other ends overlap with each other. The outer peripheral surface of the conductor core wire is covered with the barrel portion and isolated from the outside, thereby suppressing the contact of water with the outer peripheral surface of the conductor core wire. While the water may come into contact with the end of the conductor core wire (leading end), due to the presence of the high compression region in the distal end portion of the barrel portion, even when the water comes into contact with the end of the conductor core wire (leading end), the water is less likely to enter the proximal end side beyond the high compression region. In other words, while corrosion of the conductor core wire is allowed in the region close to the distal end side before the high compression region of the barrel portion, the progress of corrosion is stopped in the high compression region. Accordingly, when the axial length of the high compression region is set to a length corresponding to the service life of the terminal-equipped electrical wire, for example, although the conductor core wire may not be completely waterproofed, the function as the terminal-equipped electrical wire may be maintained at least for the service life (life extension).

Therefore, the terminal-equipped electrical wire according to this configuration has practical waterproofness without employing a seal member for waterproofing which is required in the conventional terminal-equipped electrical wire. That is, it is possible to achieve both high productivity and sustained reliability of electrical connection.

Furthermore, according to the terminal-equipped electrical wire according to this configuration, a depressing is applied at a portion where one and the other ends of the barrel portion (plate-like body) overlap with each other when the high compression region is formed at the distal end portion of the barrel portion. Accordingly, for example, the one and the other ends of the barrel portion (plate-like body) are deformed to mesh with each other, so that the internal stress around the high compression region is increased, resulting in increased adhesion between the conductor core wires, and the contact region between the terminal fitting and the conductor core wire is also increased. Thus, even when the expansion and contraction of the barrel portion is repeated due to temperature change or the like when the terminal-equipped electrical wire is used, loosening of the barrel portion is less likely to occur. Thus, the reliability of the electrical connection may be improved.

According to the terminal-equipped electrical wire according to the configuration of (2) described above, since the leading end of the conductor core wire is exposed from the barrel portion, when the conductor core wire is corroded by the galvanic corrosion described above, the leading end exposed from the barrel portion is corroded preferentially to the portion covered by the barrel portion. At this time, since the corrosion progresses gradually from the leading end of the conductor core wire, the corrosion of a portion covered by the barrel portion may be delayed by the amount of the conductor core wire exposed from the barrel portion. In other words, the corrosion of the contact portion between the barrel portion and the conductor core wire (the conductor core wire inside the barrel portion) may be suppressed by way of allowing the corrosion of the conductor core wire exposed from the barrel portion in a sacrificial manner.

According to the terminal-equipped electrical wire according to the configuration of (3) described above, even when the conductor core wire is gradually corroded in a common corrosion test for a terminal-equipped electrical wire, the end of the conductor core wire remains in the high compression region of the barrel portion, so that a good electrical connection between the terminal fitting and the conductor core wire may be maintained. In addition, examples of the common corrosion test include thermal shock tests described in JP-A-2005-174896, JP-A-2005-327690, and JP-A-2013-080682, the accelerated environmental exposure test of US standard USCAR-21 specified by SAE International, and the like.

According to the terminal-equipped electrical wire according to the configuration of (4) described above, the position of the end of the conductor core wire may be easily visually recognized at the time of crimping of the barrel portion, or the like, by providing the portion penetrating the distal end portion of the barrel portion in the thickness direction. As a result, the productivity may be further improved. In addition, the shape of the portion penetrating in the thickness direction is not particularly limited, and a notch, a through hole, and a slit, or the like may be included.

According to the terminal-equipped electrical wire according to the configuration of (5) described above, the position of the isolator of the electrical wire may be easily visually recognized at the time of crimping of the barrel portion, or the like, by providing the portion penetrating the proximal end portion of the barrel portion in the thickness direction. As a result, the productivity may be further improved. In addition, the shape of the portion penetrating in the thickness direction is not particularly limited, and a notch, a through hole, and a slit, or the like may be included.

According to the present invention, it is possible to provide a terminal-equipped electrical wire capable of achieving both high productivity and sustained reliability of the electrical connection.

The present invention has been briefly described above. Furthermore, the details of the present invention will be further clarified by reading the aspects (hereinafter referred to as "embodiments") for carrying out the invention described below with reference to the accompanying drawings.

DETAILED DESCRIPTION OF THE EMBODIMENTS

Embodiment

Figure 1A:
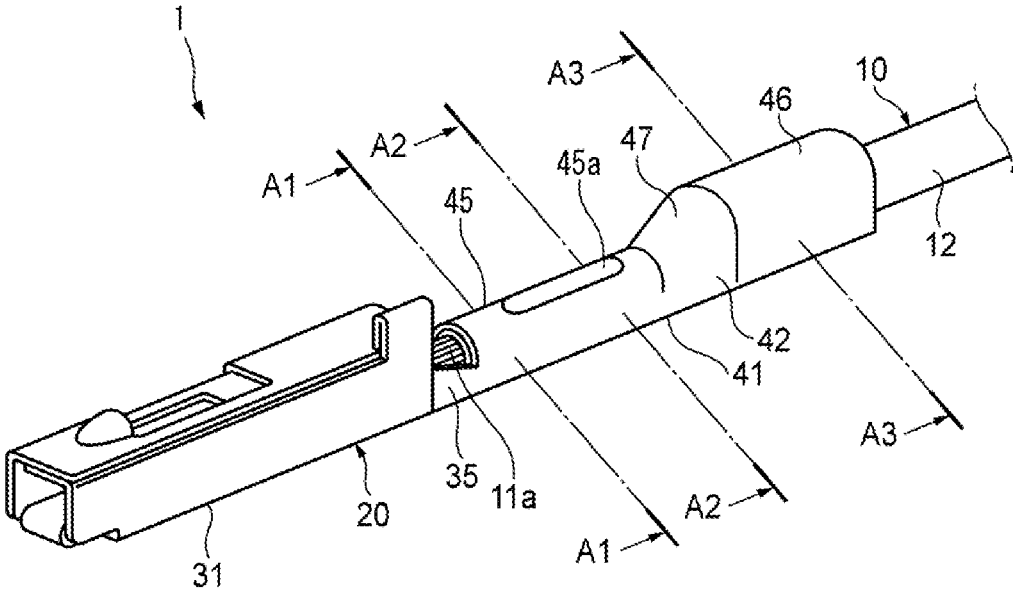
FIG. 1A is a perspective view of a terminal-equipped electrical wire according to an embodiment.

Hereinafter, a terminal-equipped electrical wire 1 including an electrical wire 10 with a terminal fitting 20 attached thereto will be described with reference to the drawings. Hereinafter, for convenience of description, in the axial direction of the terminal fitting 20 (fitting direction), the side with a mating terminal (not shown) fitted thereon (the left side in FIGS. 1A, 1B, 2, and 4) is referred to as a distal end side (front side), and the opposite side (right side in FIGS. 1A, 1B, 2 and 4) is referred to as a proximal end side (rear side). Moreover, the upper side and lower side in FIGS. 1A, 1B, 2 and 4 are referred to as upper side and lower side, respectively.

As shown in FIGS. 1A to 4, the terminal fitting 20 is crimped to an end portion of the electrical wire 10, and the terminal fitting 20 and a conductor core wire 11 of the electrical wire 10 are electrically connected. The terminal-equipped electrical wire 1 is configured by the electrical wire 10 and the terminal fitting 20. The terminal-equipped electrical wire 1 is configured as a wire harness for wiring in a vehicle such as an automobile, for example.

The electrical wire 10 is an insulated electrical wire having the conductor core wire 11 and a coating 12 made of a resin covering the conductor core wire 11. The conductor core wire 11 is formed of aluminum or an aluminum alloy, and is formed by twisting a plurality of strands. Since the conductor core wire 11 of the electrical wire 10 is formed from aluminum or an aluminum alloy, the weight of the terminal-equipped electrical wire 1 is reduced, and the weight of the wire harness including the terminal-equipped electrical wire 1 is also reduced. This light-weighted terminal-equipped electrical wire 1 is suitably used particularly for a vehicle in which a wire harness is frequently used, such as an electric car and a hybrid car.

The terminal fitting 20 includes a contact portion 31 to be connected to the mating terminal on the distal end side, and includes, on the proximal end side, a barrel portion 41 to be connected to the conductor core wire 11 of the electrical wire 10. The contact portion 31 and the barrel portion 41 are connected to each other by a connecting portion 35.

The terminal fitting 20 is formed by pressing (stamping and bending) a metal plate (plate-like body). The terminal fitting 20 is formed of a metal material different from the aluminum or aluminum alloy constituting the conductor core wire 11. Specifically, the terminal fitting 20 is formed by using a metal plate (plate-like body) made of copper or copper alloy as a base material.

The terminal fitting 20 is stamped by pressing, and then preferably subjected to a plating treatment for the purpose of suppressing corrosion of the conductor core wire 11 of the electrical wire 10 to improve corrosion resistance and the like before being crimped to the electrical wire 10. In this example, the terminal fitting 20 is subjected to the plating treatment with a tin (Sn) before being crimped to the electrical wire 10. Specifically, the terminal fitting 20 is provided with a plated layer including the tin to cover a side surface that includes front and back surfaces and a cut surface formed by pressing.

Figure 1B:
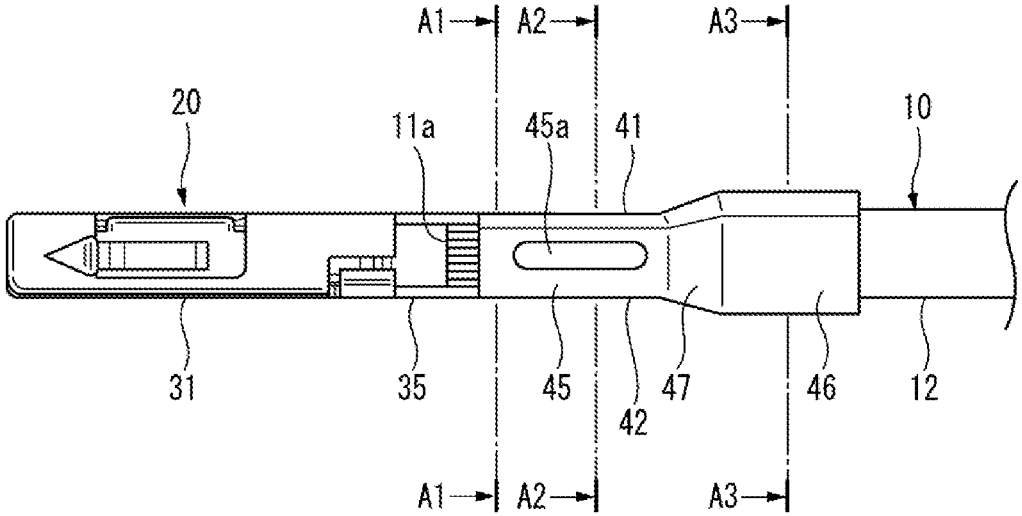
FIG. 1B is a plan view of the terminal-equipped electrical wire.

As described above, after being subjected to surface treatment, the contact portion 31 is formed in a rectangular cylindrical shape in which the distal end portion is opened as shown in FIGS. 1A and 1B. The mating terminal is inserted into the opening portion of the contact portion 31, and the contact portion 31 and the mating terminal are electrically connected.

Figure 2:
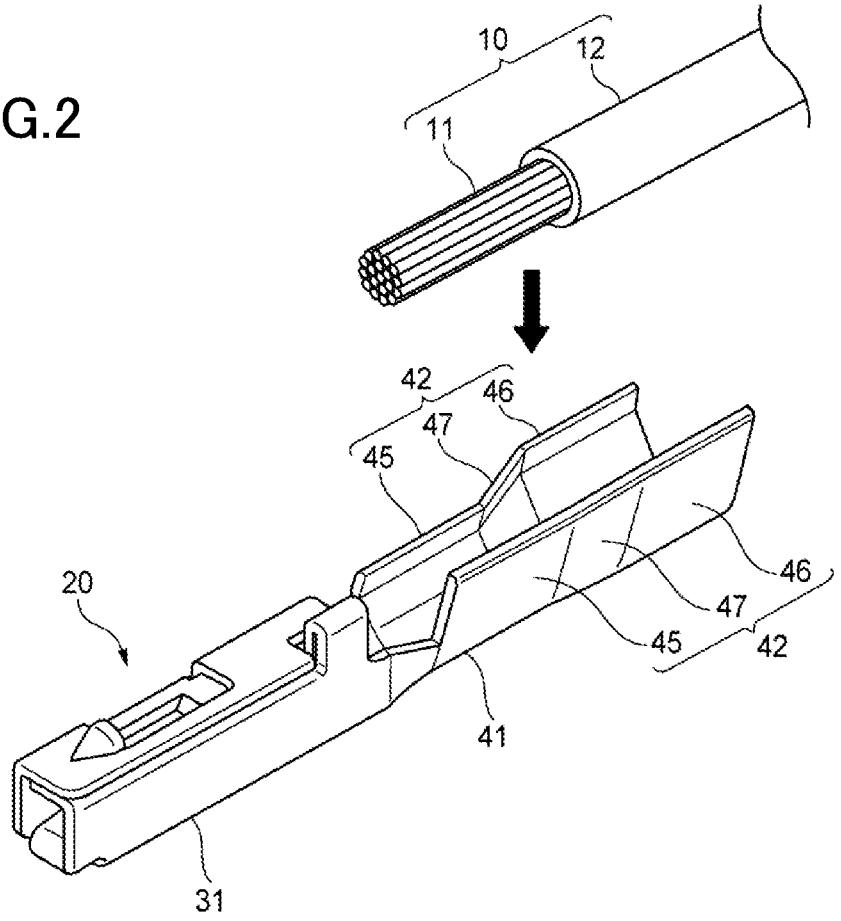
FIG. 2 is a perspective view showing how an electrical wire is attached to a terminal fitting.

The barrel portion 41 is crimped to the end portion of the electrical wire 10 to be electrically connected. As shown in FIG. 2, the barrel portion 41 includes a pair of crimping pieces 42. Each of the crimping pieces 42 includes a distal end side as a conductor crimping portion 45 and a proximal end side as a coating crimping portion 46. Further, the crimping piece 42 includes a connecting portion 47 between the conductor crimping portion 45 and the coating crimping portion 46. That is, each of the crimping pieces 42 (the sum of the conductor crimping portion 45, the connecting portion 47, and the coating crimping portion 46) is continuous in the axial direction (fitting direction).

Figure 3A:
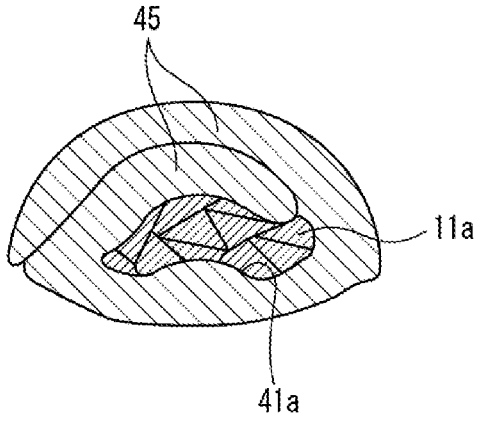
FIG. 3A is a cross-sectional view taken along line A1-A1 of FIG. 1A.
Figure 3B:
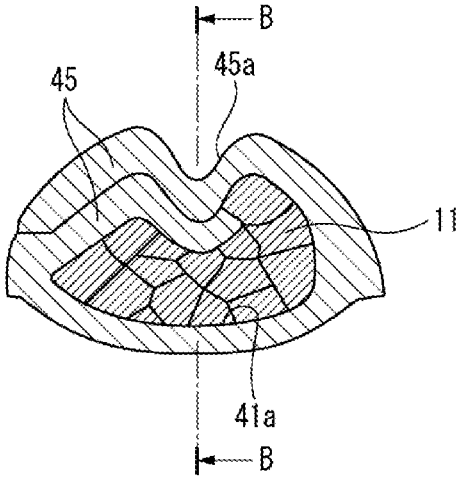
FIG. 3B is a cross-sectional view taken along line A2-A2 of FIG. 1A.
Figure 3C:
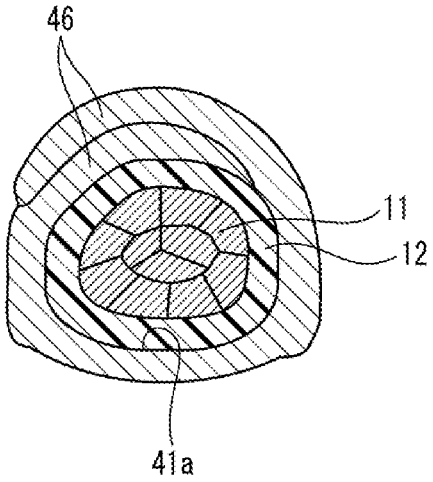
FIG. 3C is a cross-sectional view taken along line A3-A3 of FIG. 1A.

As shown in FIGS. 3A to 3C, the pair of crimping pieces 42 are then crimped so that an extension end portion of one crimping piece 42 overlaps within an extension end portion of the other crimping piece 42 and crimped to the end portion of the electrical wire 10. Hereinafter, for convenience of description, one crimping piece 42 and the other crimping piece 42 are also referred to as "inner crimping piece 42" and "outer crimping piece 42", respectively.

Figure 5:
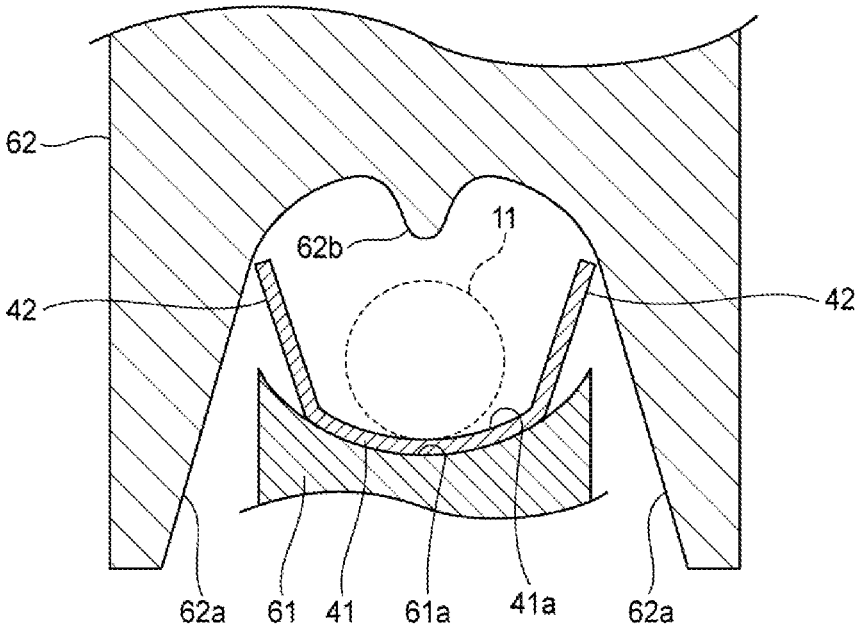
FIG. 5 is a cross-sectional view showing a state in which a pair of crimping pieces of a barrel portion of a terminal fitting is crimped by using an upper die and a lower die.

In the barrel portion 41, an upper surface side (inner surface side) of the plate-like body is a placement surface 41*a* on which the end portion of the electrical wire 10 is placed. In this example, when the pair of crimping pieces 42 of the barrel portion 41 are crimped, a lower die (anvil) 61 and an upper die (crimper) 62 shown in FIG. 5 are used. A support surface 61*a* is formed on an upper surface of the lower die 61. A pair of guide inclined surfaces 62*a* and a protrusion 62*b* are formed on a lower surface of the upper die 62, in which the protrusion 62*b* projects downward at a place where upper end portions of the pair of the guide inclined surfaces 62*a* meet.

As shown in FIG. 5, with the end portion of the electrical wire 10 (conductor core wire 11) being placed on the placement surface 41*a* of the barrel portion 41, and with the barrel portion 41 being supported by the support surface 61*a* of the lower die 61, the upper die 62 is moved closer to the lower die 61 from above.

As a result, first, the extension end portions of the pair of crimping pieces 42 abutting the guide inclined surface 62*a* of the upper die 62 are slid along the pair of guide inclined surfaces 62*a*, whereby the pair of crimping pieces 42 are crimped to wrap around the end portion of the electrical wire 10, while the extension end portion of the inner crimping piece 42 overlaps the inside of the extension end portion of the outer crimping piece 42. Next, the protrusion 62*b* presses a portion of the conductor crimping portion 45 where the extension end portions of the inner crimping piece 42 and the outer crimping piece 42 overlap with each other, from the upper side toward the lower side.

As a result, as shown in FIGS. 1A, 1B, 3 and 4, the conductor crimping portion 45 is crimped to the conductor core wire 11 of the electrical wire 10, and the coating crimping portion 46 is crimped to the coating 12 of the electrical wire 10. As a result, the barrel portion 41 having a cylindrical shape is crimped to the end portion of the electrical wire 10, so that the conductor crimping portion 45 covers the conductor core wire 11 of the electrical wire 10, the coating crimping portion 46 covers the coating 12 of the electrical wire 10, and the connecting portion 47 covers the conductor core wire 11 to be isolated from the outside between the conductor crimping portion 45 and the coating crimping portion 46. In this example, a leading end 11*a* of the conductor core wire 11 of the electrical wire 10 is located further to the distal end side than the opening in the distal end side of the barrel portion 41 (conductor crimping portion 45) having a cylindrical shape, and exposed from the barrel portion 41.

After crimping, in the barrel portion 41 having a cylindrical shape, the thickness of the coating crimping portion 46 is about the outer diameter of the electrical wire 10, while the thickness of the conductor crimping portion 45 is smaller than the coating crimping portion 46. As described above, since the thicknesses of the two are different from each other, the connecting portion 47 located between them has a shape that gradually increases in thickness as it moves from the distal end side extending to the conductor crimping portion 45, to the proximal end side extending to the coating crimping portion 46.

Figure 4:
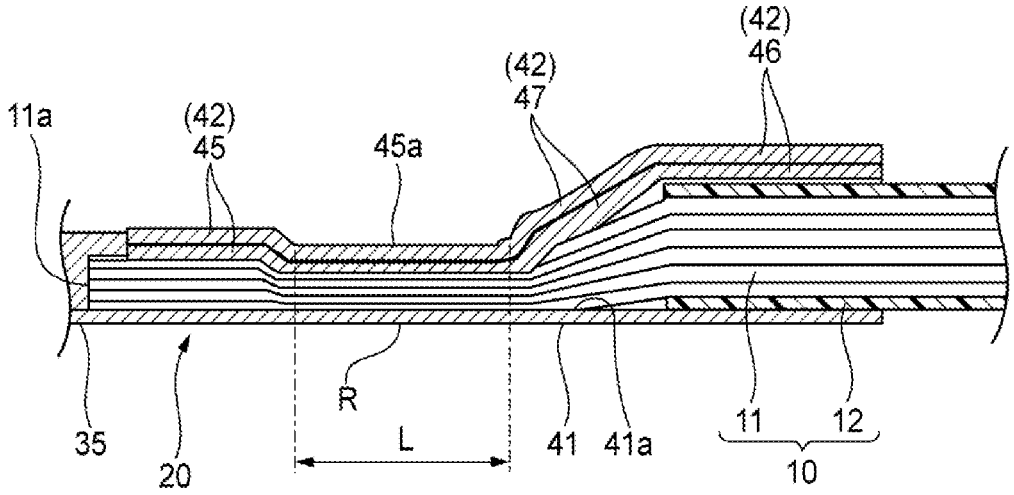
FIG. 4 is a cross-sectional view taken along line B-B of FIG. 3B.

Furthermore, as shown in FIGS. 1A, 1B, 3B and 4, a depressed portion 45*a* recessed downward is formed in a region pressed by the protrusion 62*b* in a portion of the conductor crimping portion 45, where the extension end portions of the inner crimping piece 42 and the outer crimping piece 42 overlap with each other. In this example, as shown in FIGS. 1A, 1B, and 4, the depressed portion 45*a* extends in an axial direction from a predetermined position that is closer to the proximal end side than the distal end side opening of the conductor crimping portion 45, to a position near the end portion of the conductor crimping portion 45 on the proximal end side (i.e., near a boundary portion between the conductor crimping portion 45 and the connecting portion 47). In particular, as shown in FIG. 3B, the depressed portion 45*a* is formed by partially downwardly depressing each of the extension end portions of the inner crimping piece 42 and the outer crimping piece 42 in the conductor crimping portion 45, and a bottom surface of the depressed portion 45*a* has a downwardly depressed shape. As a result, at the portion with the depressed portion 45*a* formed in the conductor crimping portion 45, the extension end portions of the inner crimping piece 42 and the outer crimping piece 42 come into close contact with each other to mesh with each other.

In this example, a "core wire compression rate" is defined as ((S1−S2)/S1), which is a ratio of "value obtained by subtracting the cross-sectional area S2 of the conductor core wire 11 after crimping from the cross-sectional area S1 of the conductor core wire 11 before crimping" with respect to "the cross-sectional area S1 of the conductor core wire 11 before crimping". Further, a region where the depressed portion 45*a* in the conductor crimping portion 45 is formed in the axial direction is defined as "high compression region R" (see FIG. 4).

In the terminal-equipped electrical wire 1, the terminal fitting 20 is crimped to the conductor core wire 11 such that the high compression region R in the conductor crimping portion 45 has the core wire compression rate greater than the core wire compression rate of the region other than the high compression region R in the conductor crimping portion 45.

As described above, according to the terminal-equipped electrical wire 1 according to the embodiment of the present invention, the barrel portion 41 is crimped to the conductor core wire 11 to form a cylindrical shape in which one and the other ends overlap with each other, so that the outer peripheral surface of the conductor core wire 11 is covered with the barrel portion 41 and isolated from the outside, thereby suppressing the contact of water with the outer peripheral surface of the conductor core wire 11.

While the water may come into contact with the end of the conductor core wire 11 (leading end 11*a*), due to the presence of the high compression region R in the conductor crimping portion 45 of the barrel portion 41, even when the water comes into contact with the end of the conductor core wire 11, the water is less likely to enter the proximal end side beyond the high compression region R. In other words, while corrosion of the conductor core wire 11 is allowed in the region close to the distal end side before the high compression region R of the barrel portion 41, the progress of corrosion is stopped in the high compression region R. Accordingly, when the axial length L of the high compression region R is set to a length corresponding to the service life of the terminal-equipped electrical wire 1, for example, although the conductor core wire 11 may not be completely waterproofed, the function as the terminal-equipped electrical wire 1 may be maintained at least for the service life (life extension). Further, the length corresponding to the service life may be determined by experiment or the like.

Therefore, the terminal-equipped electrical wire 1 according to this configuration has practical waterproofness without employing a seal member for waterproofing which is required in the conventional terminal-equipped electrical wire. That is, it is possible to achieve both high productivity and sustained reliability of electrical connection.

Furthermore, the high compression region R is formed by providing the depressed portion 45*a* in the conductor crimping portion 45. Furthermore, the one and the other ends of the barrel portion 41 (plate-like body) are deformed to mesh with each other by depressing a portion where one and the other ends of the barrel portion 41 (plate-like body) overlap with each other, so that the internal stress around the high compression region R is increased, resulting in increased adhesion between the conductor core wires 11, and the contact region between the terminal fitting 20 and the conductor core wire 11 is also increased. Thus, even when the expansion and contraction of the barrel portion 41 is repeated due to temperature change or the like when the terminal-equipped electrical wire 1 is used, loosening of the barrel portion 41 is less likely to occur. Thus, the reliability of the electrical connection may be improved.

Furthermore, since the leading end 11*a* of the conductor core wire 11 is exposed from the barrel portion 41, when the conductor core wire 11 is corroded by the galvanic corrosion described above, the leading end 11*a* exposed from the barrel portion 41 is corroded preferentially to the portion covered by the barrel portion 41. At this time, since the corrosion progresses gradually from the leading end 11*a* of the conductor core wire 11, the corrosion of a portion covered by the barrel portion 41 may be delayed by the amount of the conductor core wire 11 exposed from the barrel portion 41. In other words, the corrosion of the contact portion between the barrel portion 41 and the conductor core wire 11 (the conductor core wire 11 inside the barrel portion 41) may be suppressed by way of allowing the corrosion of the conductor core wire 11 exposed from the barrel portion 41 in a sacrificial manner.

In this example, it is preferable that an amount of exposure of the conductor core wire 11 from the barrel portion 41 (exposed length in the axial direction) is an amount of exposure of the end of the conductor core wire 11 in the high compression region R when the conductor core wire 11 is corroded in a predetermined corrosion test. Accordingly, even when the conductor core wire 11 is gradually corroded in a predetermined corrosion test, the end of the conductor core wire 11 remains in the high compression region R of the barrel portion 41, so that a good electrical connection between the terminal fitting 20 and the conductor core wire 11 may be maintained. In addition, examples of the predetermined corrosion test include thermal shock tests described in JP-A-2005-174896, JP-A-2005-327690, and JP-A-2013-080682, the accelerated environmental exposure test of US standard USCAR-21 specified by SAE International, and the like.

Other Embodiments

The present invention is not limited to the embodiments described above, and various modifications can be adopted within the scope of the present invention. For example, the present invention is not limited to the embodiment described above, but may be appropriately changed, modified, and the like. In addition, materials, shapes, dimensions, numbers, placement locations, and the like of the constituent elements in the embodiment described above are arbitrary as far as the present invention can be achieved, and are not limited.

Figure 6A:
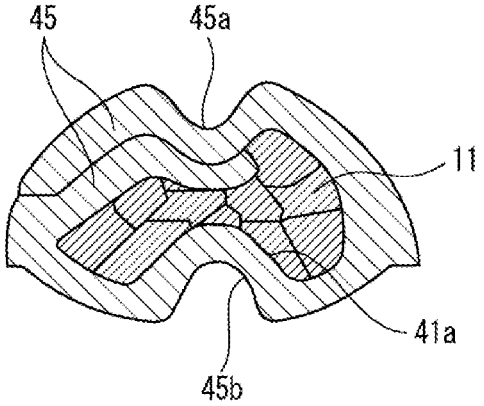
FIG. 6A is a view showing a terminal-equipped electrical wire according to a modification of the embodiment, corresponding to FIG. 3B.
Figure 6B:
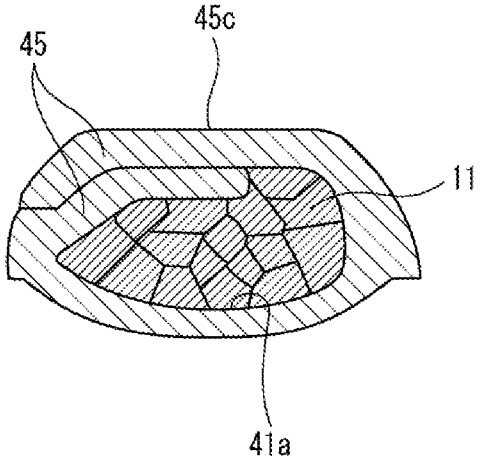
FIG. 6B is a view showing a terminal-equipped electrical wire according to another modification of the embodiment, corresponding to FIG. 3B.

In the above embodiment, in order to form the high compression region R (see FIG. 4), as shown in FIG. 3B, the depressed portion 45*a* is formed only on the upper surface of the conductor crimping portion 45 (the portion where the extension end portions of the inner crimping piece 42 and the outer crimping piece 42 overlap with each other). However, the depressed portion 45*a* is not limited to such a form. For example, in order to form a high compression region R (see FIG. 4), as shown in FIG. 6A, a depressed portion 45*a* is formed on the upper surface of the conductor crimping portion 45, and furthermore, a depressed portion 45*b* may be formed on the lower surface of the conductor crimping portion 45. Further, as shown in FIG. 6B, a depressed portion 45*c* having a flat bottom surface may be formed as a depressed portion for forming the high compression region R.

Figure 7:
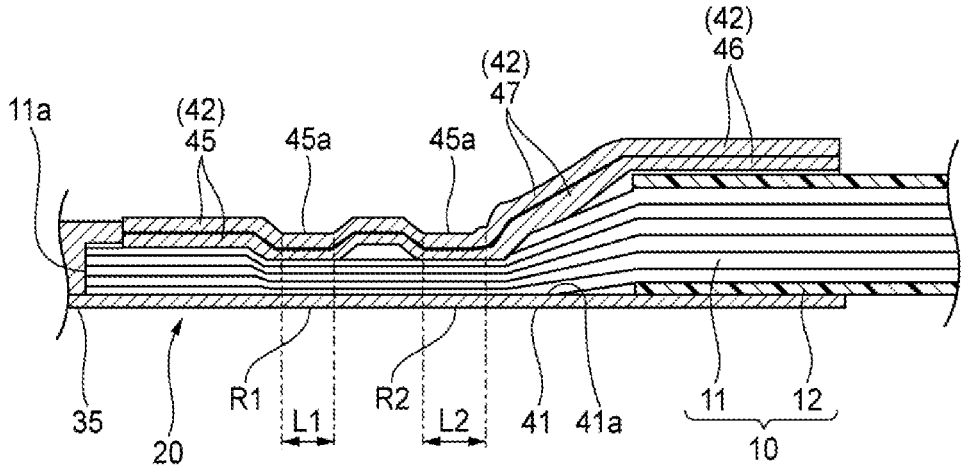
FIG. 7 is a view showing a terminal-equipped electrical wire according to another modification of the embodiment, corresponding to FIG. 4.

Furthermore, in the above embodiment, as shown in FIG. 4, the high compression region R (depressed portion 45*a*) is formed at only one axial position in the conductor crimping portion 45. On the other hand, as shown in FIG. 7, the high compression regions R1 and R2 (depressed portions 45*a*) may be formed at a plurality of axial locations (two locations in FIG. 7) in the conductor crimping portion 45. As described above, when the depressed portions 45*a* and 45*b* are provided at a plurality of axial positions, it is preferable that the sum of the axial lengths L1 and L2 of the plurality of depressed portions 45*a* and 45*b* is set to the length corresponding to the service life of the terminal-equipped electrical wire 1.

Figure 8A:
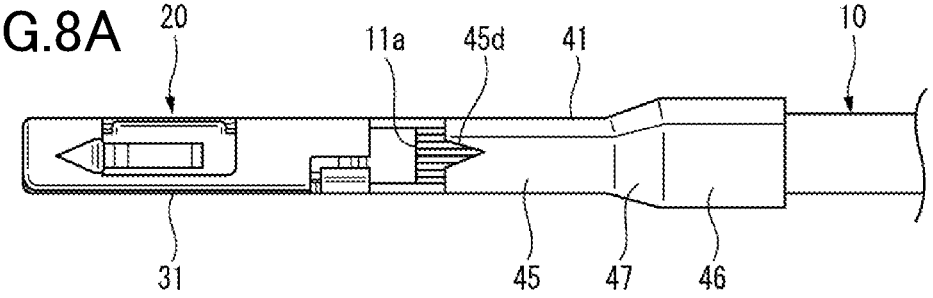
FIGS. 8A to 8C are views showing a terminal-equipped electrical wire according to still another modification of the embodiment, corresponding to FIG. 1B.
Figure 8B:
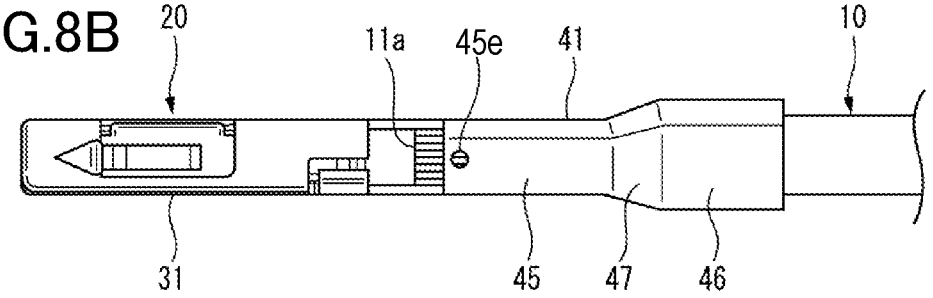
Figure 8C:
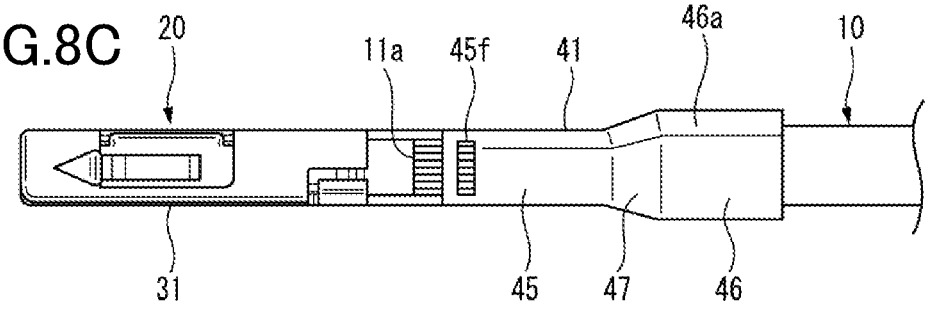

Furthermore, as shown in FIGS. 8A to 8C, portions 45*d*, 45*e*, and 45*f* penetrating the conductor crimping portion 45 in the thickness direction may be formed at the distal end portion of the conductor crimping portion 45 of the barrel portion 41 so that the conductor core wire 11 may be visually recognized. In FIGS. 8A, 8B, and 8C, a notch 45*d*, a through hole 45*e*, and a slit 45*f* are illustrated respectively as the penetrating portions described above. As described above, the position of the end of the conductor core wire 11 may be easily visually recognized at the time of crimping of the barrel portion 41, or the like, by providing the portion penetrating the distal end portion of the barrel portion 41 in the thickness direction. As a result, the productivity may be further improved.

Figure 9A:
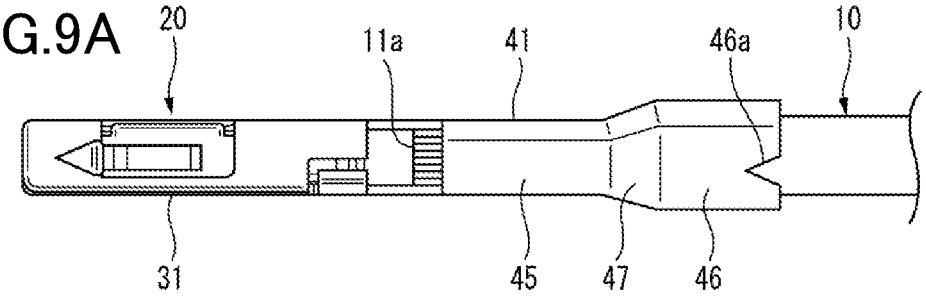
FIGS. 9A to 9C are views showing a terminal-equipped electrical wire according to still another modification of the embodiment, corresponding to FIG. 1B.
Figure 9B:
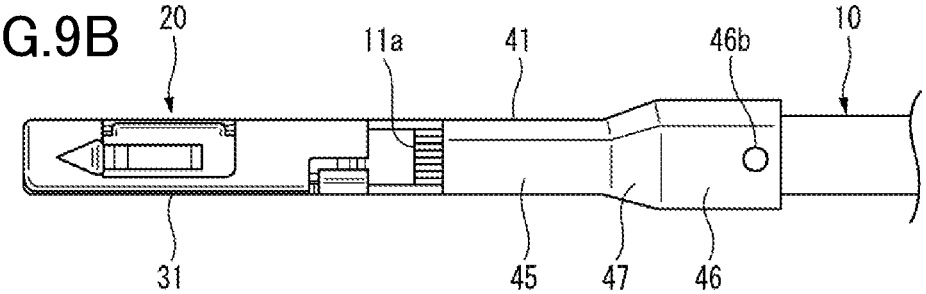
Figure 9C:
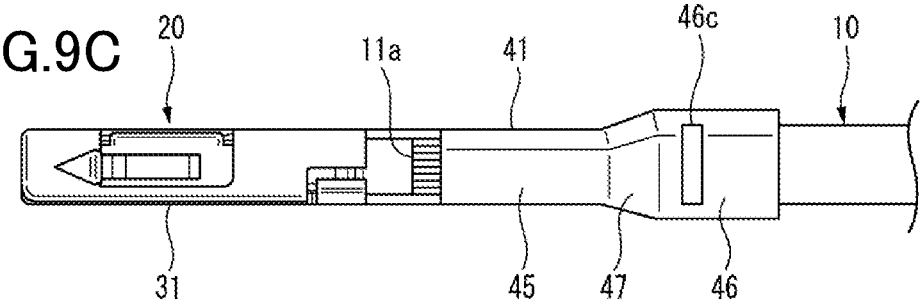

Furthermore, as shown in FIGS. 9A to 9C, portions 46*a*, 46*b*, and 46*c* penetrating the coating crimping portion 46 in the thickness direction may be formed at the proximal end portion of the coating crimping portion 46 of the barrel portion 41 so that the coating 12 of the electrical wire 10 may be visually recognized. In FIGS. 9A, 9B, and 9C, a notch 46*a*, a through hole 46*b*, and a slit 46*c* are illustrated as the penetrated portions described above, respectively. As described above, the position of the coating 12 of the electrical wire 10 may be easily visually recognized at the time of crimping of the barrel portion 41, or the like, by providing the portion penetrating the proximal end portion of the barrel portion 41 in the thickness direction. As a result, the productivity may be further improved.

Here, the features of the embodiment of the terminal-equipped electrical wire 1 according to the present invention described above will be briefly summarized and listed as (1) to (5) below, respectively.

(1)

A terminal-equipped electrical wire (1) including an electrical wire (10) and a terminal fitting (20) attached to the electrical wire (10), in which the terminal fitting (20) includes:

a barrel portion (41) crimped to a conductor core wire (11) exposed from the electrical wire (10), and a contact portion (31) to be connected to a mating terminal, and the barrel portion (41) is a cylindrical plate-like body in which one end and the other end overlap with each other after crimping, and has a plate-like body including a proximal end portion (46) covering a sheath (12) of the electrical wire (10), a distal end portion (45) covering the conductor core wire (11) away from the proximal end portion (46), and an intermediate portion (47) connecting the proximal end portion (46) and the distal end portion (45) and covering the conductor core wire (11) so as to isolate it from the outside between the proximal end portion (46) and the distal end portion (45), and when a core wire compression rate is defined as ((S1−S2)/S1) which is a ratio of a value obtained by subtracting a [cross-sectional area S2 of the conductor core wire (11) after crimping from the cross-sectional area S1 of the conductor core wire (11) before crimping] with respect to the [cross-sectional area S1 of the conductor core wire (11) before crimping], the barrel portion (41) is crimped to the conductor core wire (11) such that the core wire compression rate of a high compression region (R), which is located closer to the proximal end side than the opening at the distal end side in the distal end portion (45), is greater than the core wire compression rate of the region other than the high compression region (R) in the distal end portion (45), and the barrel portion (41) includes:

regions (45*a*, 45*b*, and 45*c*) depressed in a direction to reduce the cross-sectional area of the conductor core wire (11) as the high compression region (R) provided at a portion where the one end and the other end overlap with each other in the distal end portion (45).

(2)

The terminal-equipped electrical wire (1) according to (1), in which an end of the conductor core wire (11) is exposed from the barrel portion (41) and extends away from the barrel portion (41).

(3)

The terminal-equipped electrical wire (1) according to (2), in which an amount of exposure of the conductor core wire (11) from the barrel portion (41) is an amount of exposure of the end of the conductor core wire (11) in the high compression region (R) when the conductor core wire (11) is corroded in a predetermined corrosion test.

(4)

The terminal-equipped electrical wire (1) according to any one of (1) to (3), in which the barrel portion (41) includes portions (45*d*, 45*e*, and 45*f*) penetrating the distal end portion (45) in a thickness direction of the distal end portion (45) so that the conductor core wire (11) may be visually recognized.

(5)

The terminal-equipped electrical wire (1) according to any one of (1) to (4), in which the barrel portion (41) includes portions (46*a*, 46*b*, and 46*c*) penetrating the proximal end portion (46) in the thickness direction of the proximal end portion (46) so that the sheath (12) may be visually recognized.

What is claimed is:

1. A terminal-equipped electrical wire comprising:

an electrical wire; and a terminal fitting that is attached to the electrical wire, wherein the terminal fitting includes:

a barrel portion crimped to a conductor core wire exposed from the electrical wire; and a contact portion to be connected to a mating terminal, and the barrel portion is a cylindrical plate-like body in which one end and the other end overlap with each other after crimping, and has a plate-like body including a proximal end portion covering a sheath of the electrical wire, a distal end portion covering the conductor core wire away from the proximal end portion, and an intermediate portion connecting the proximal end portion and the distal end portion and covering the conductor core wire so as to isolate it from the outside between the proximal end portion and the distal end portion, and when a core wire compression rate is defined as ((S1−S2)/S1) which is a ratio of a value obtained by subtracting a cross-sectional area S2 of the conductor core wire after crimping from the cross-sectional area S1 of the conductor core wire before crimping with respect to the cross-sectional area S1 of the conductor core wire before crimping, the barrel portion is crimped to the conductor core wire such that the core wire compression rate of a high compression region, which is located closer to the proximal end side than the opening at the distal end side in the distal end portion, is greater than the core wire compression rate of the region other than the high compression region in the distal end portion, and the barrel portion includes at least one depressed region that is depressed where the one end and the other end of the barrel portion overlap in a direction to reduce the cross-sectional area of the conductor core wire as the high compression region provided at a portion where the one end and the other end overlap with each other in the distal end portion.

2. The terminal-equipped electrical wire according to claim 1, wherein an end of the conductor core wire is exposed from the barrel portion and extends 5 away from the barrel portion.

3. The terminal-equipped electrical wire according to claim 1, wherein a plurality of depressed regions are formed at a plurality of axial positions, along the electric wire, where the one end and the other end of the barrel portion overlap, and each of the plurality of depressed regions have an inward concave shape.

4. The terminal-equipped electrical wire according to claim 1, wherein a plurality of high compression regions are formed at a plurality of axial positions, along the electric wire where the one end and the other end of the barrel portion, overlap.

5. The terminal-equipped electrical wire according to claim 1, wherein a first depressed region is formed at a first-high compression region and a second depressed region is formed at a second-high compression region, and compression rates of the first and second-high compression regions are equal, and an intermediate region is formed between the first and second-high compression regions, in which the intermediate region has a lower compression rate than the compression rates of both of the first high compression region and the second high compression region.

6. A terminal-equipped electrical wire comprising:

an electrical wire; and a terminal fitting that is attached to the electrical wire, wherein the terminal fitting includes:

a barrel portion crimped to a conductor core wire exposed from the electrical wire; and a contact portion to be connected to a mating terminal, and the barrel portion is a cylindrical plate-like body in which one end and the other end overlap with each other after crimping, and has a plate-like body including a proximal end portion covering a sheath of the electrical wire, a distal end portion covering the conductor core wire away from the proximal end portion, and an intermediate portion connecting the proximal end portion and the distal end portion and covering the conductor core wire so as to isolate it from the outside between the proximal end portion and the distal end portion, and when a core wire compression rate is defined as ((S1−S2)/S1) which is a ratio of a value obtained by subtracting a cross-sectional area S2 of the conductor core wire after crimping from the cross-sectional area S1 of the conductor core wire before crimping with respect to the cross-sectional area S1 of the conductor core wire before crimping, the barrel portion is crimped to the conductor core wire such that the core wire compression rate of a high compression region, which is located closer to the proximal end side than the opening at the distal end side in the distal end portion, is greater than the core wire compression rate of the region other than the high compression region in the distal end portion, the barrel portion includes regions depressed in a direction to reduce the cross-sectional area of the conductor core wire as the high compression region provided at a portion where the one end and the other end overlap with each other in the distal end portion, and the barrel portion includes portions penetrating the distal end portion in a thickness direction of the distal end portion so that the conductor core wire is visually recognizable.

7. A terminal-equipped electrical wire comprising:

an electrical wire; and a terminal fitting that is attached to the electrical wire, wherein the terminal fitting includes:

a barrel portion crimped to a conductor core wire exposed from the electrical wire; and a contact portion to be connected to a mating terminal, and the barrel portion is a cylindrical plate-like body in which one end and the other end overlap with each other after crimping, and has a plate-like body including a proximal end portion covering a sheath of the electrical wire, a distal end portion covering the conductor core wire away from the proximal end portion, and an intermediate portion connecting the proximal end portion and the distal end portion and covering the conductor core wire so as to isolate it from the outside between the proximal end portion and the distal end portion, and when a core wire compression rate is defined as ((S1−S2)/S1) which is a ratio of a value obtained by subtracting a cross-sectional area S2 of the conductor core wire after crimping from the cross-sectional area S1 of the conductor core wire before crimping with respect to the cross-sectional area S1 of the conductor core wire before crimping, the barrel portion is crimped to the conductor core wire such that the core wire compression rate of a high compression region, which is located closer to the proximal end side than the opening at the distal end side in the distal end portion, is greater than the core wire compression rate of the region other than the high compression region in the distal end portion, the barrel portion includes regions depressed in a direction to reduce the cross-sectional area of the conductor core wire as the high compression region provided at a portion where the one end and the other end overlap with each other in the distal end portion, and the barrel portion includes portions penetrating the proximal end portion in the thickness direction of the proximal end portion so that the sheath is visually recognizable.

* * * * *